US011767094B2

(12) United States Patent
Saruwatari

(10) Patent No.: US 11,767,094 B2
(45) Date of Patent: Sep. 26, 2023

(54) OUTBOARD MOTOR

(71) Applicant: YAMAHA HATSUDOKI KABUSHIKI KAISHA, Iwata (JP)

(72) Inventor: Kimitaka Saruwatari, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 160 days.

(21) Appl. No.: 17/412,309

(22) Filed: Aug. 26, 2021

(65) Prior Publication Data

US 2022/0111946 A1 Apr. 14, 2022

(30) Foreign Application Priority Data

Oct. 14, 2020 (JP) ..... 2020-173038

(51) Int. Cl.
*B63H 23/34* (2006.01)
*B63H 20/32* (2006.01)

(52) U.S. Cl.
CPC ..... *B63H 23/34* (2013.01); *B63H 20/32* (2013.01)

(58) Field of Classification Search
CPC ..... B63H 23/34; B63H 20/32
See application file for complete search history.

(56) References Cited

U.S. PATENT DOCUMENTS 5,178,565 A * 1/1993 Jacobson ..... B63H 5/165 416/247 A
5,647,781 A * 7/1997 Johnson, Sr. ..... C12Q 1/6886 604/320
2005/0250394 A1* 11/2005 Nakamura ..... B63H 20/12 440/53
2007/0214852 A1* 9/2007 Frantz ..... B63J 99/00 348/E7.061
2009/0098783 A1* 4/2009 Cribbs ..... B63H 20/06 440/63

FOREIGN PATENT DOCUMENTS

JP 2005-329830 A 12/2005
JP 2007055312 A * 3/2007 ..... B63H 20/34
JP 6287521 B2 * 3/2018 ..... B63H 20/14

OTHER PUBLICATIONS

English Translation P-2007055312-A (Year: 2007).*
English Translation JP-2007055312-A (Year: 2007).*
English Translation JP-6287521-B2 (Year: 2018).*

* cited by examiner

*Primary Examiner* — Shafiq Mian
(74) *Attorney, Agent, or Firm* — KEATING AND BENNETT, LLP

(57) ABSTRACT

An outboard motor includes a propeller shaft, a lower case, an upper case, and a splash guard. The lower case houses the propeller shaft. The upper case is located above the lower case. The splash guard includes an upper plate that projects forward from the upper case. The splash guard is separate from the upper case and is attached to the upper case.

6 Claims, 11 Drawing Sheets

OUTBOARD MOTOR

CROSS REFERENCE TO RELATED APPLICATIONS

This application claims the benefit of priority to Japanese Patent Application No. 2020-173038 filed on Oct. 14, 2020. The entire contents of this application are hereby incorporated herein by reference.

BACKGROUND OF THE INVENTION

1. Field of the Invention

The present invention relates to an outboard motor.

2. Description of the Related Art

Some outboard motors are equipped with a splash guard. For example, as illustrated in Japan Laid-open Patent Application Publication No. 2005-329830, the splash guard has a plate-like shape and projects from the lower case forward of the outboard motor. The splash guard prevents splashes from rising from the stern of the boat. Conventionally, the splash guard is integral with the upper case by casting.

By enlarging the splash guard, the effect of suppressing splashes can be improved. However, when a large splash guard is manufactured by casting together with an upper case, the weight increases, which makes the manufacturing difficult. In addition, the manufacturing equipment becomes large.

Alternatively, a small splash guard may be required depending on the model of the outboard motor or the usage conditions. However, when the splash guard is integral with the upper case by casting as in the conventional case, it is not easy to replace the splash guard with a smaller one.

SUMMARY OF THE INVENTION

Preferred embodiments of the present invention provide outboard motors that each facilitate replacement and manufacture of a splash guard.

An outboard motor according to a preferred embodiment of the present invention includes a propeller shaft, a lower case, an upper case, and a splash guard. The lower case houses the propeller shaft. The upper case is located above the lower case. The splash guard includes an upper plate that projects forward from the upper case. The splash guard is separate from the upper case and is attached to the upper case.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
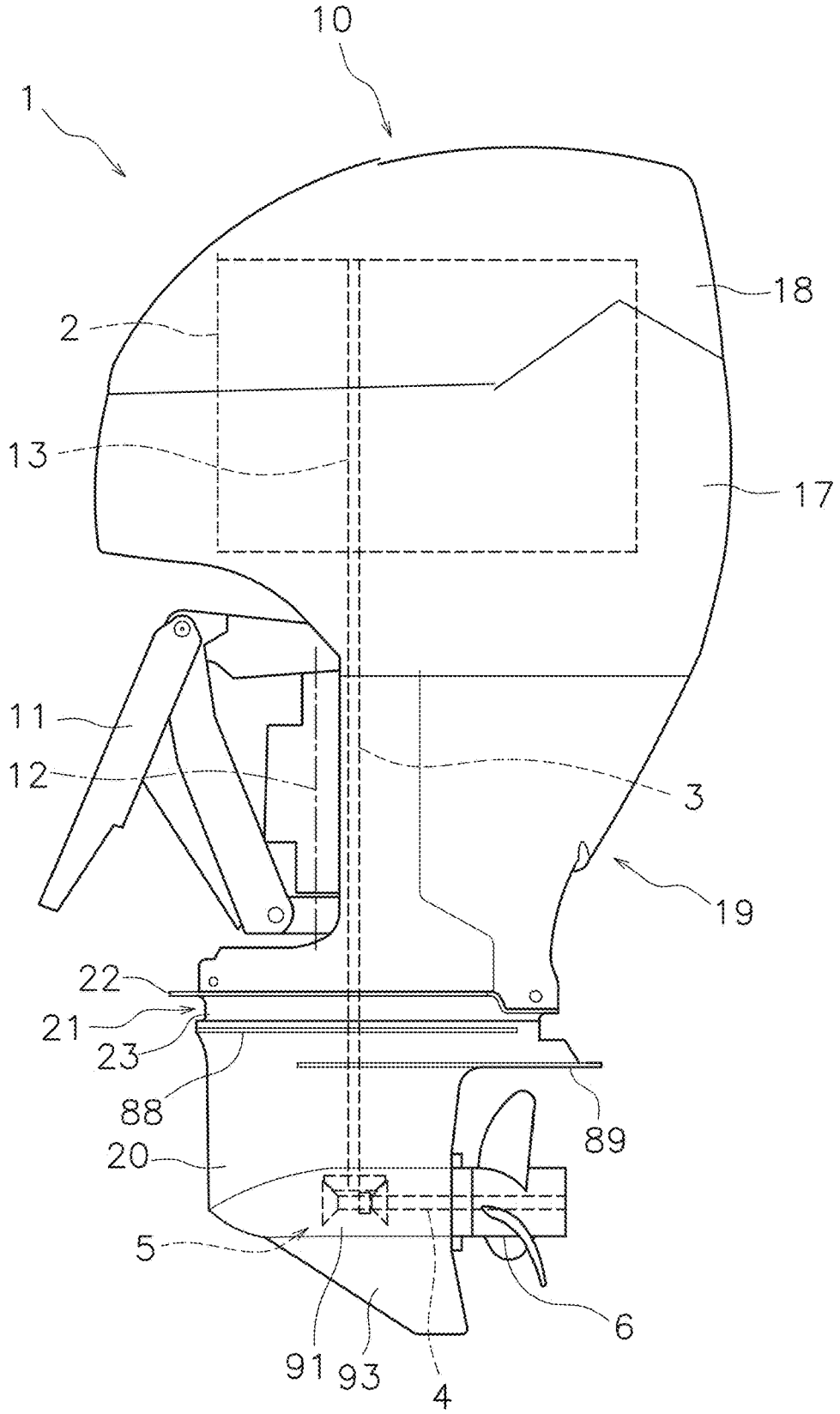
FIG. 1 is a side view of an outboard motor according to a preferred embodiment of the present invention.

Hereinafter, preferred embodiments of the present invention will be described with reference to the drawings. FIG. 1 is a side view of an outboard motor 1 according to a preferred embodiment of the present invention. The outboard motor 1 is attached to a boat via a bracket 11. The outboard motor 1 generates thrust to propel the boat. The bracket 11 supports the outboard motor 1 so as to be rotatable around a steering shaft 12. The steering shaft 12 extends in a vertical direction of the outboard motor 1.

The outboard motor 1 includes a drive unit 2, a drive shaft 3, a propeller shaft 4, and a shift mechanism 5. The drive unit 2 generates thrust to propel the boat. The drive unit 2 is an internal combustion engine, for example. The drive unit 2 includes a crankshaft 13. The crankshaft 13 extends in the vertical direction of the outboard motor 1. The drive shaft 3 is connected to the crankshaft 13. The drive shaft 3 extends in the vertical direction of the outboard motor 1.

The propeller shaft 4 extends in a front-rear direction of the outboard motor 1. The propeller shaft 4 is connected to the drive shaft 3 via the shift mechanism 5. A propeller 6 is attached to the propeller shaft 4. The shift mechanism 5 includes a plurality of gears and a clutch. The shift mechanism 5 switches the transmission direction of rotation from the drive shaft 3 to the propeller shaft 4. As a result, forward and reverse propulsion of the boat is switched.

The outboard motor 1 includes a housing 10. The housing 10 houses the drive unit 2, the drive shaft 3, the propeller shaft 4, and the shift mechanism 5. The housing 10 includes a bottom cowl 17, an upper cowl 18, an upper case 19, and a lower case 20. The bottom cowl 17 supports the drive unit 2. The upper cowl 18 is located above the bottom cowl 17. The upper cowl 18 is attached to the bottom cowl 17. The upper case 19 is located below the bottom cowl 17. The upper case 19 is located above the lower case 20. The lower case 20 houses the propeller shaft 4 and the shift mechanism 5.

Figure 2:
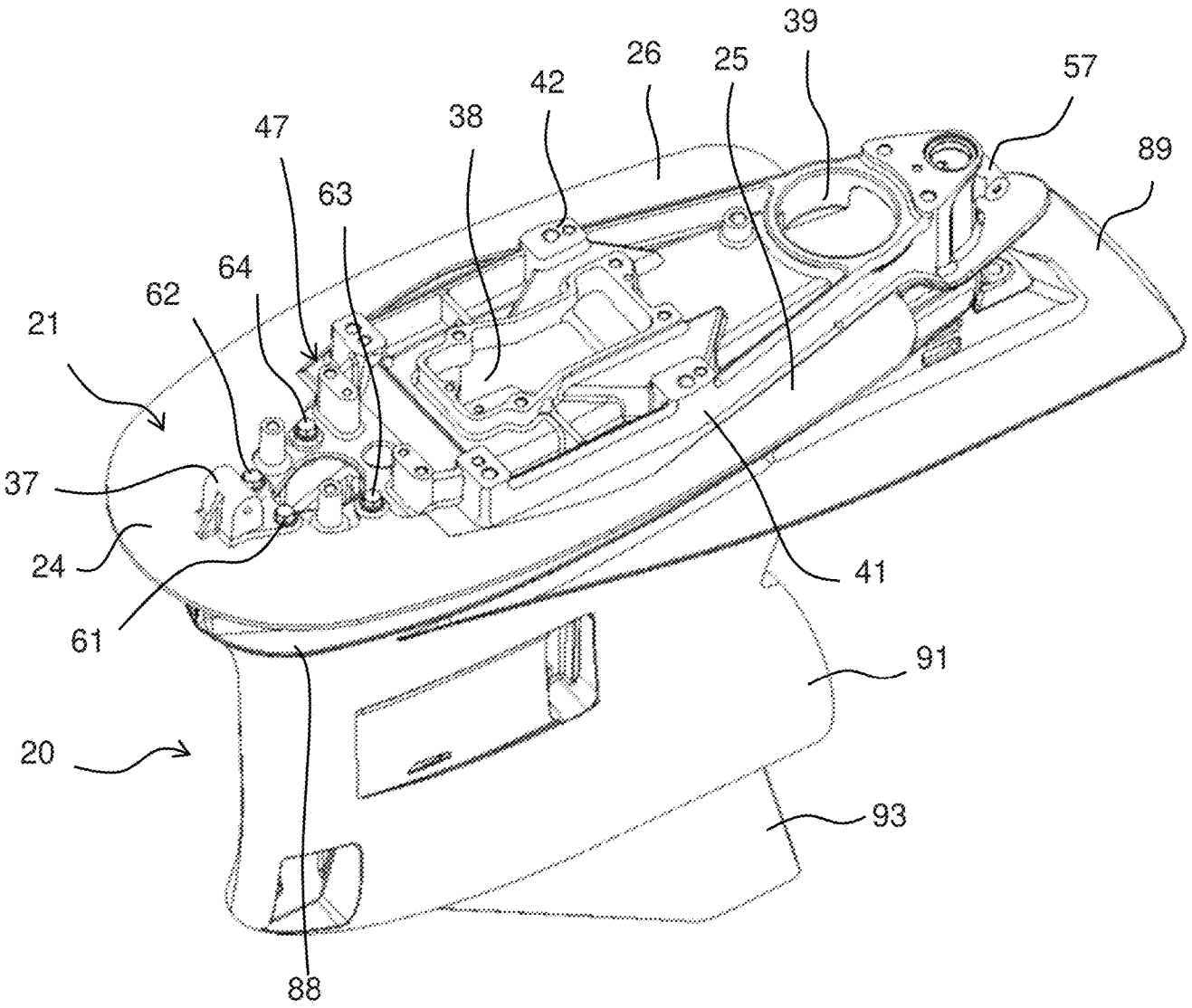
FIG. 2 is a perspective view of a lower portion of the outboard motor.
Figure 3:
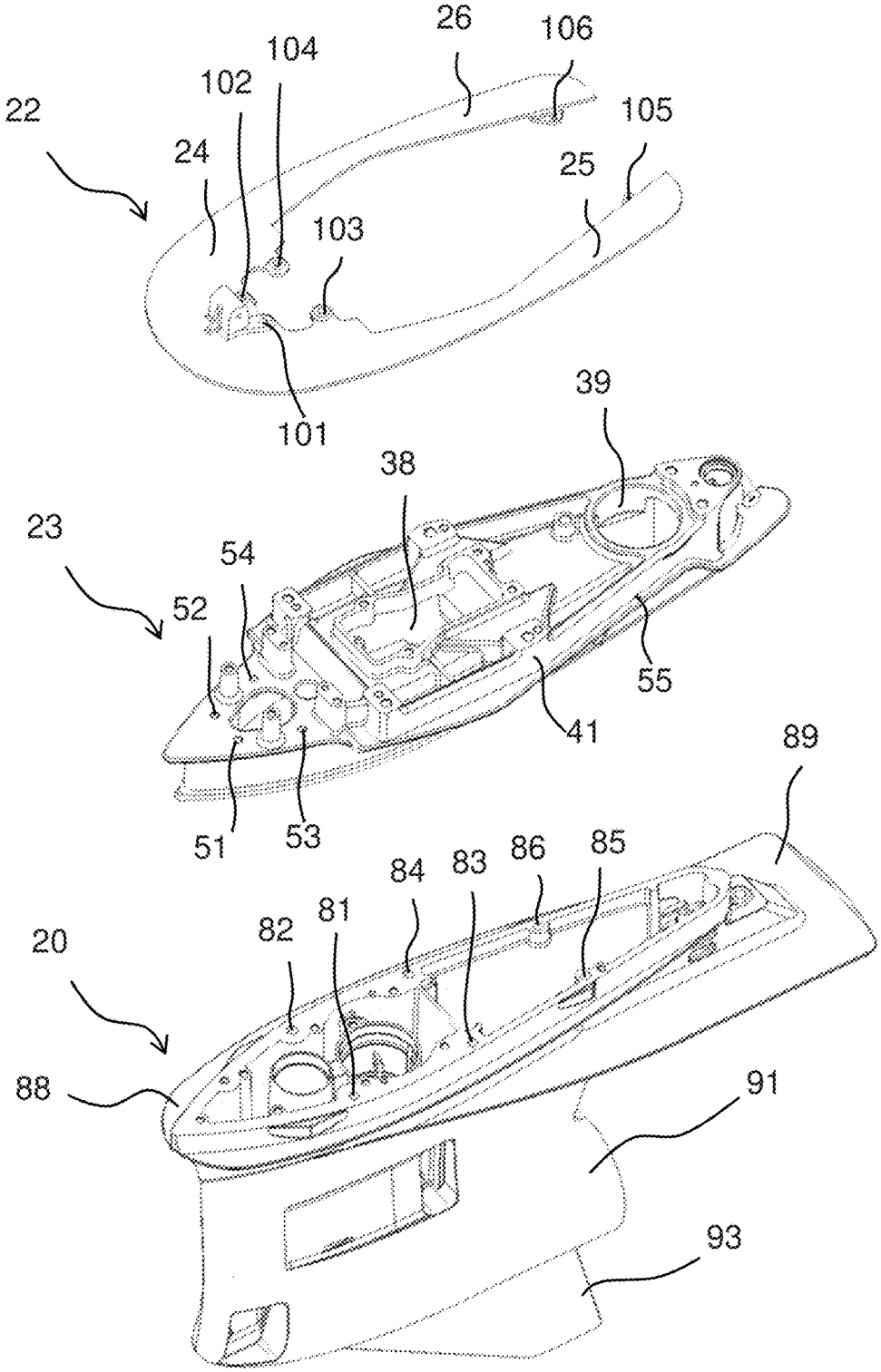
FIG. 3 is an exploded view of the lower portion of the outboard motor.

FIG. 2 is a perspective view of the lower portion of the outboard motor 1. FIG. 3 is an exploded view of the lower portion of the outboard motor 1. As illustrated in FIGS. 2 and 3, the outboard motor 1 includes a splash guard 21. The splash guard 21 is separate from the upper case 19 and the lower case 20. The splash guard 21 is located between the upper case 19 and the lower case 20. The splash guard 21 is attached to the upper case 19 and the lower case 20.

The splash guard 21 includes an upper plate 22 and an attachment 23. The upper plate 22 projects forward from the upper case 19. The upper plate 22 is located between the upper case 19 and the attachment 23. The upper plate 22 projects forward from the attachment 23. The upper plate 22 projects from the attachment 23 to the left and right sides. The upper plate 22 projects from the upper case 19 to the left and right sides.

Figure 4:
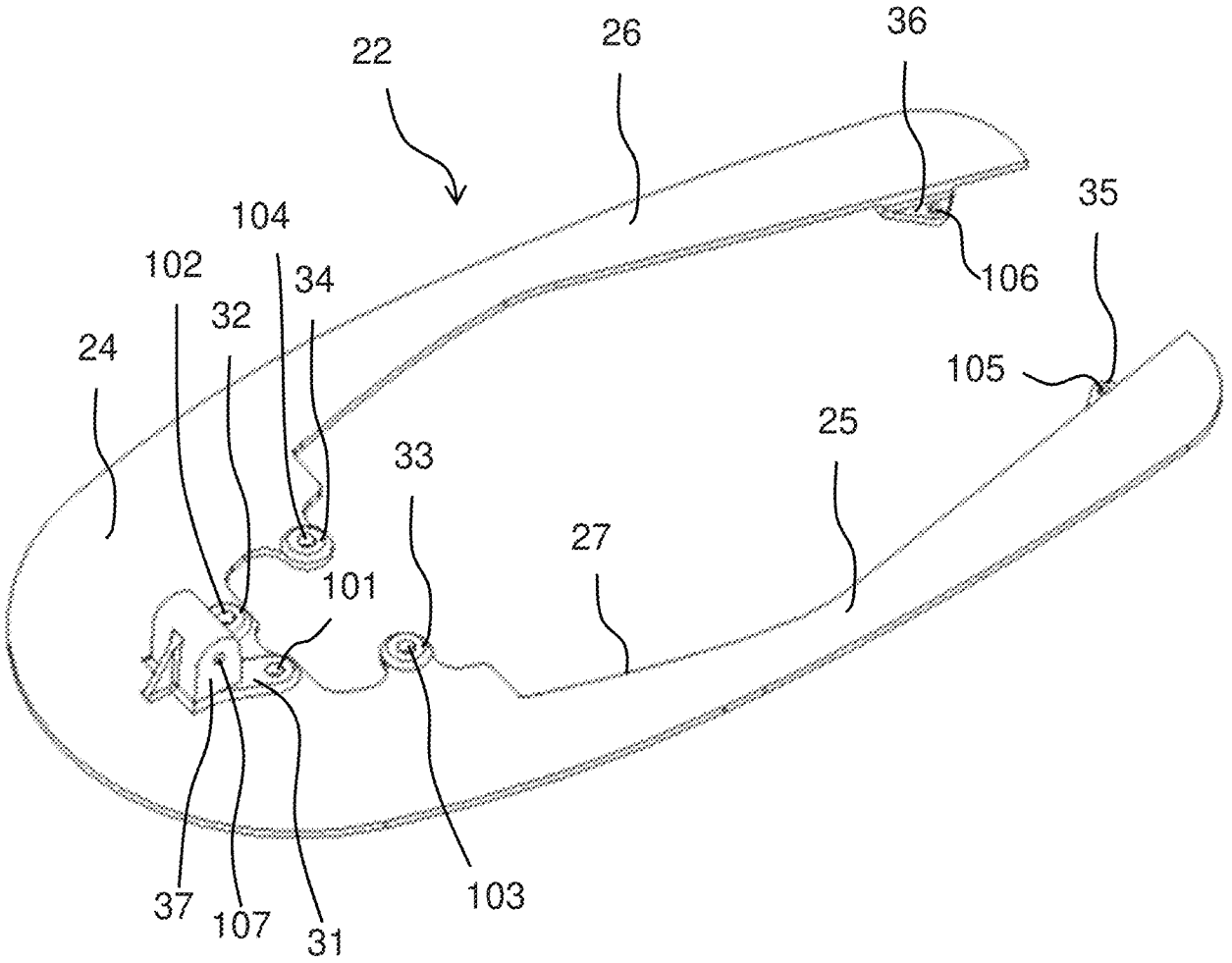
FIG. 4 is a perspective view of an upper plate.

The upper plate 22 is separate from the attachment 23. The upper plate 22 is attached to the attachment 23. The upper plate 22 is attached to the upper case 19 via the attachment 23. The upper plate 22 is preferably made of metal such as aluminum or stainless steel, for example. FIG. 4 is a perspective view of the upper plate 22. As illustrated in FIG. 4, the upper plate 22 includes a front plate 24, a left extension 25, and a right extension 26. The front plate 24 projects forward and to the left and right from the attachment 23. The left extension 25 extends rearward from the front plate 24. The right extension 26 extends rearward from the front plate 24. The upper plate 22 includes a recess 27. The recess 27 is located between the left extension 25 and the right extension 26. The recess 27 has a shape that is recessed toward the front.

The upper plate 22 includes a plurality of mounts 31 to 36. The plurality of mounts 31 to 36 are fixed to the attachment 23. The plurality of mounts 31 to 36 include the first to sixth mounts 31 to 36. The first to sixth mounts 31 to 36 include holes 101 to 106, respectively. The holes 101 to 106 of the first to sixth mounts 31 to 36 penetrate through the upper plate 22 in the vertical direction. The first mount 31 and the second mount 32 are provided on the front plate 24. The first mount 31 and the second mount 32 are located in front of the recess 27. The third mount 33 and the fourth mount 34 are located rearward of the first mount 31 and the second mount 32. The third mount 33 and the fourth mount 34 project toward the inside of the recess 27. The fifth mount 35 and the sixth mount 36 are located rearward of the third mount 33 and the fourth mount 34. The fifth mount 35 and the sixth mount 36 project toward the inside of the recess 27.

The upper plate 22 includes a first case support 37. The first case support 37 is provided on the front plate 24. The first case support 37 projects upward from the front plate 24. The first case support 37 includes a bolt hole 107.

Figure 5:
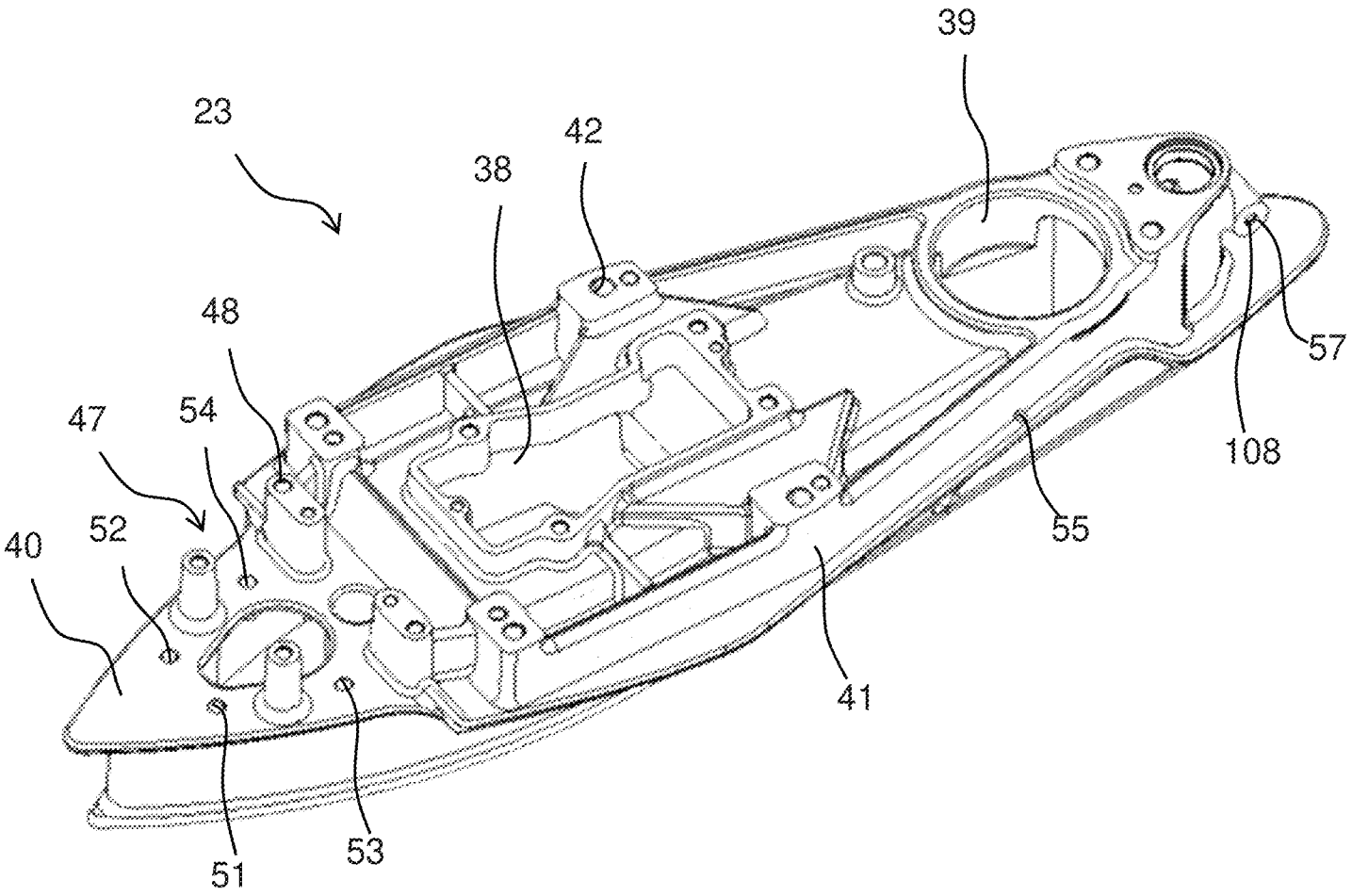
FIG. 5 is a perspective view of an attachment.
Figure 6:
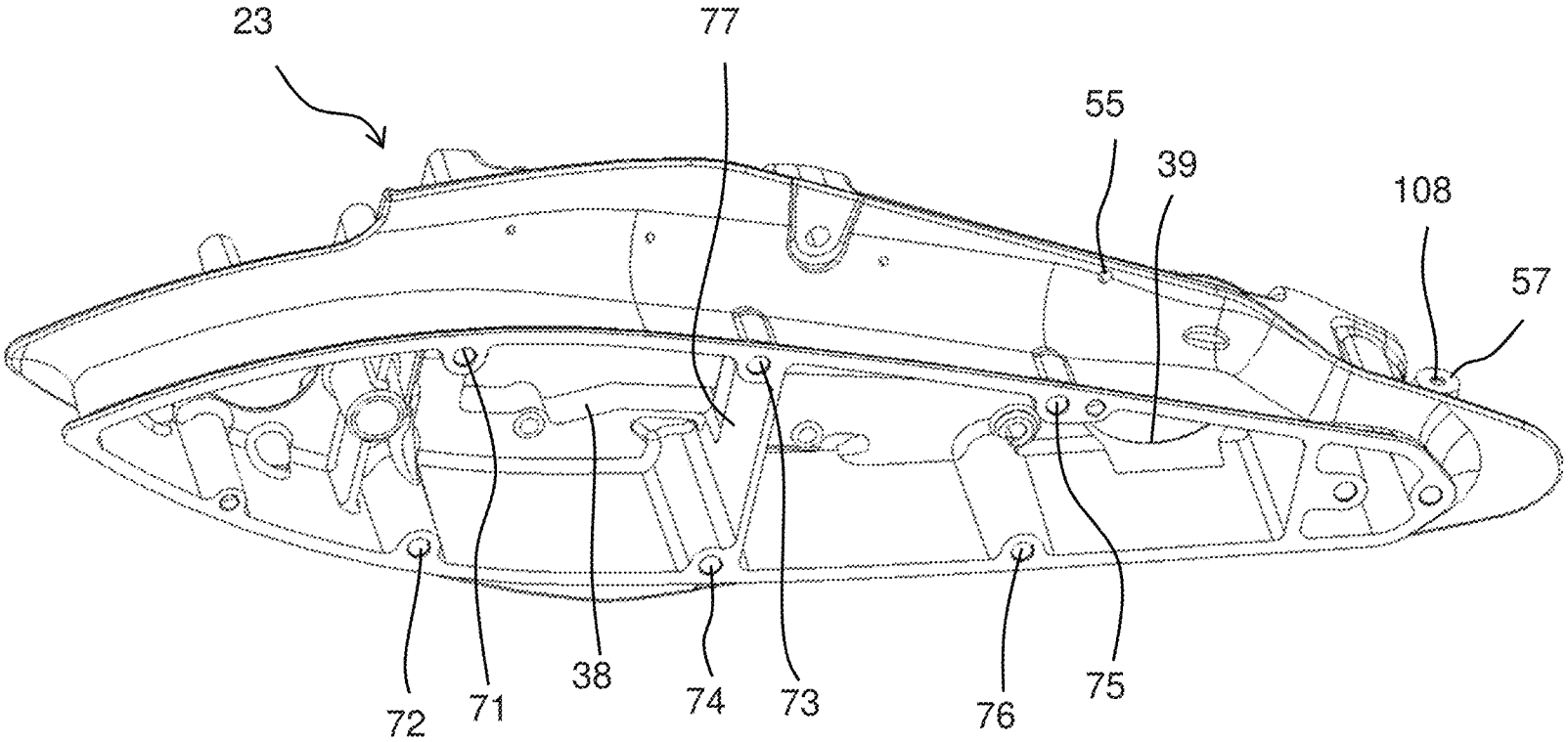
FIG. 6 is a perspective view of the attachment.
Figure 7:
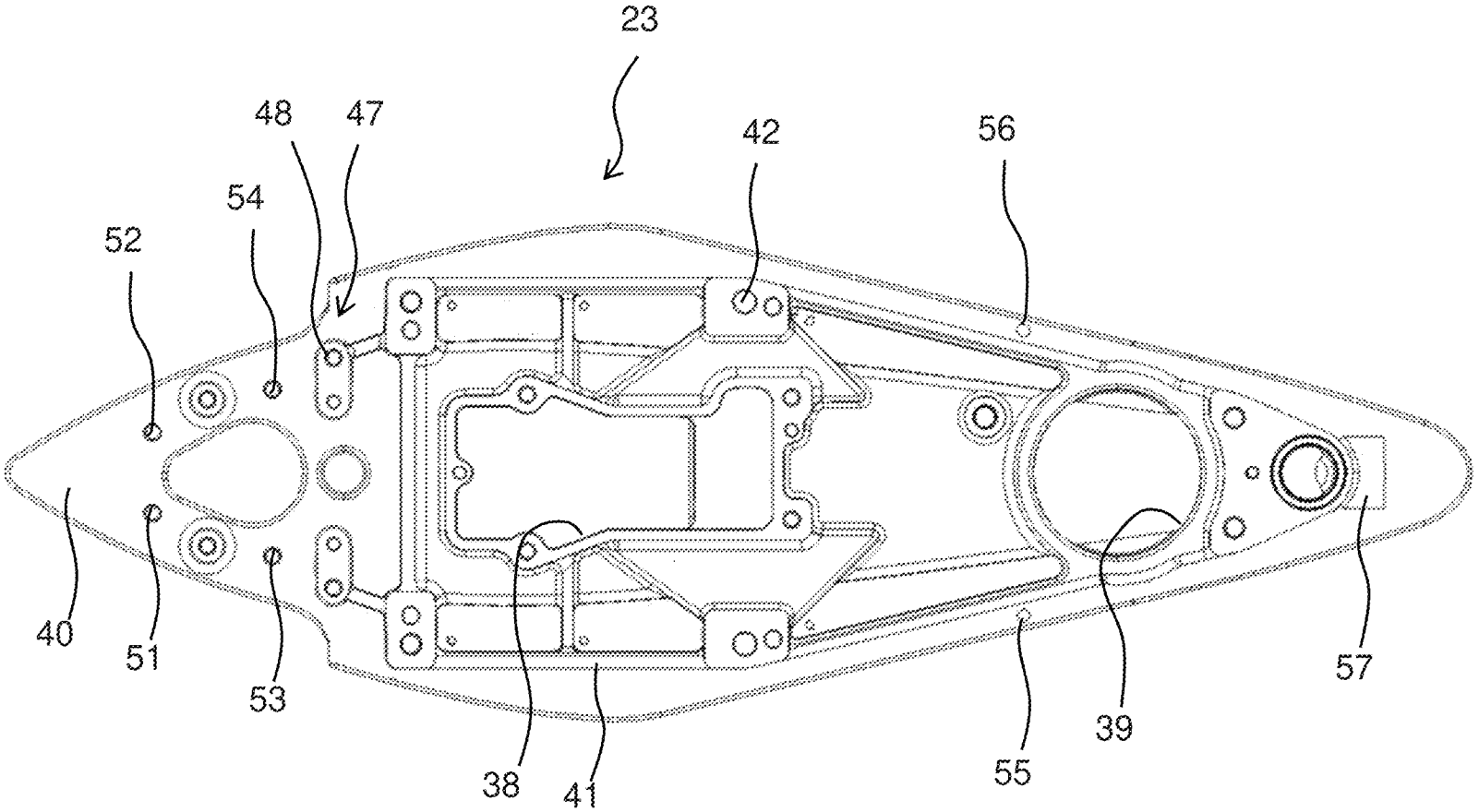
FIG. 7 is a top view of the attachment.

The attachment 23 is separate from the lower case 20 and the upper case 19. The attachment 23 is located between the lower case 20 and the upper case 19. The attachment 23 is attached to the lower case 20 and the upper case 19. The attachment 23 is preferably made of metal such as aluminum or stainless steel, for example. The attachment 23 may be integrally molded by casting. FIGS. 5 and 6 are perspective views of the attachment 23. FIG. 7 is a top view of the attachment 23. As illustrated in FIG. 5, the attachment 23 includes a first hole 38 and a second hole 39. The first hole 38 and the second hole 39 penetrate through the attachment 23 in the vertical direction. The drive shaft 3 extends through the first hole 38. An exhaust pipe (not illustrated) extending from the drive unit 2 extends through the second hole 39.

The upper surface of the attachment 23 includes a flat portion 40 and a frame support 41. The flat portion 40 is located in front of and on both lateral sides of the frame support 41. The upper plate 22 is located on the flat portion 40. The frame support 41 projects upward from the flat portion 40. The frame support 41 is provided in the recess 27 of the upper plate 22. The frame support 41 surrounds the first hole 38. The frame support 41 includes a plurality of bolt holes 42. In the drawings, reference numeral 42 indicates only one of the plurality of bolt holes, and the reference numerals of the other bolt holes are omitted.

Figure 8:
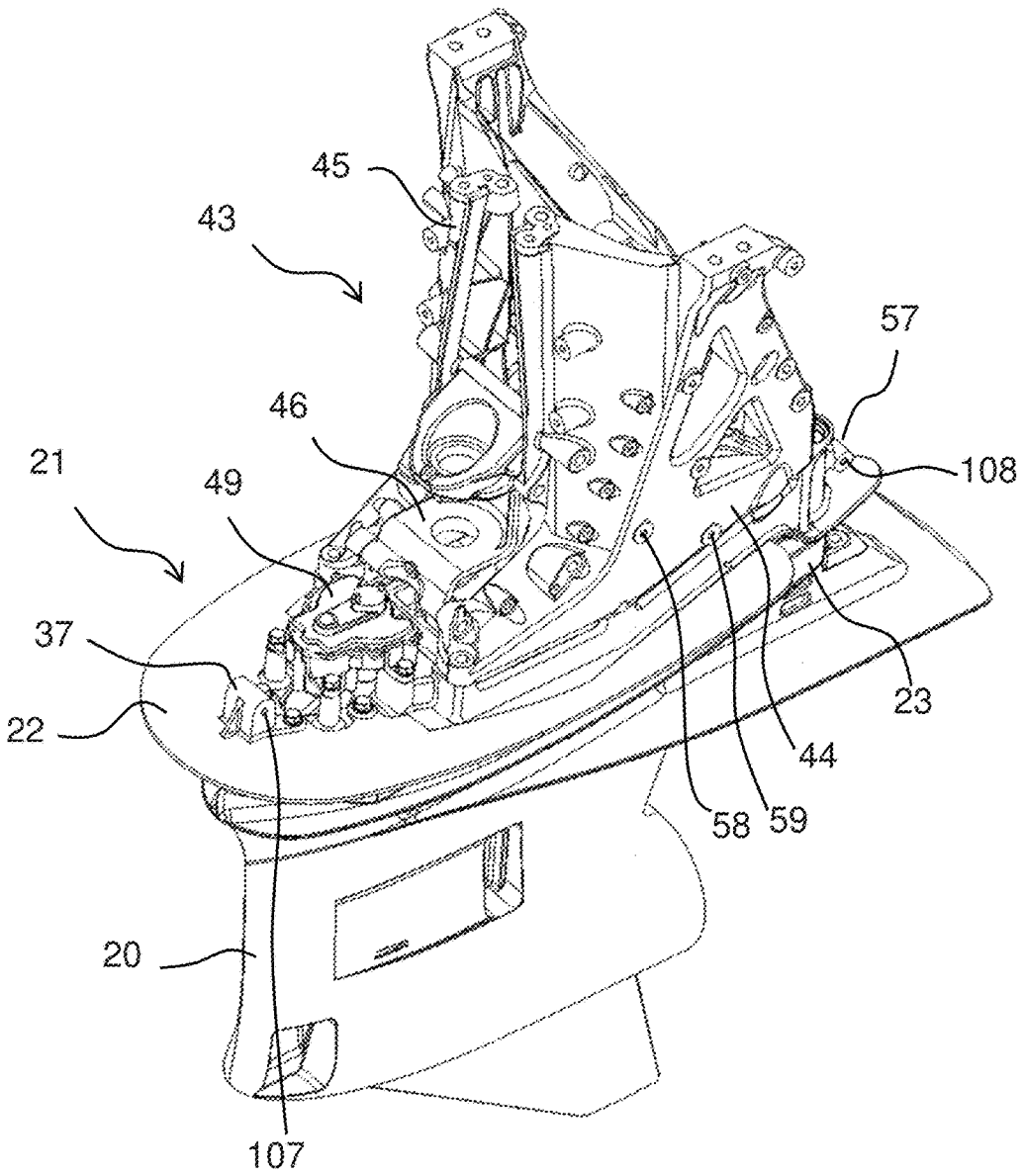
FIG. 8 is a perspective view of the lower portion of the outboard motor.

As illustrated in FIG. 8, the frame 43 is provided on the frame support 41. The frame 43 supports the bracket 11. The frame 43 is provided in the upper case 19. The frame 43 includes a left frame 44, a right frame 45, and a center frame 46. The center frame 46 is located between the left frame 44 and the right frame 45. The bracket 11 is attached to the center frame 46.

As illustrated in FIG. 5, the upper surface of the attachment 23 includes a component support 47. The component support 47 is located in front of the frame support 41. The component support 47 projects upward from the flat portion 40. The component support 47 is provided in the recess 27 of the upper plate 22. The component support 47 includes a plurality of bolt holes 48. In the drawings, reference numeral 48 indicates only one of the plurality of bolt holes, and the reference numerals of the other bolt holes are omitted. As illustrated in FIG. 8, a component 49 is attached to the component support 47.

As illustrated in FIGS. 5 and 7, the upper surface of the attachment 23 includes a plurality of bolt holes 51 to 56. The plurality of bolt holes 51 to 56 include first to sixth bolt holes 51 to 56. The first to sixth bolt holes 51 to 56 correspond to the first to sixth mounts 31 to 36 of the upper plate 22, respectively. The bolt holes 51 to 56 are provided in the flat portion 40. The bolt holes 51 to 54 are located in front of the frame support 41. The bolt holes 55 and 56 are located on the left and right sides of the frame support 41.

As illustrated in FIG. 2, the upper plate 22 is fixed to the attachment 23 by, for example, a plurality of bolts 61 to 64. The first bolt 61 extends through the hole 101 of the first mount 31 of the upper plate 22 and the first bolt hole 51 of the attachment 23. The second bolt 62 extends through the hole 102 of the second mount 32 of the upper plate 22 and the second bolt hole 52 of the attachment 23. The third bolt 63 extends through the hole 103 of the third mount 33 of the upper plate 22 and the third bolt hole 53 of the attachment 23. The fourth bolt 64 extends through the hole 104 of the fourth mount 34 of the upper plate 22 and the fourth bolt hole 54 of the attachment 23. Although not illustrated, a bolt also extends through the hole 105 of the fifth mount 35 of the upper plate 22 and the fifth bolt hole 55 of the attachment 23. Further, a bolt also extends through the hole 106 of the sixth mount 36 of the upper plate 22 and the sixth bolt hole 56 of the attachment 23. The head portions of the bolts 61 to 64 are located on the upper surface of the upper plate 22.

Figure 9:
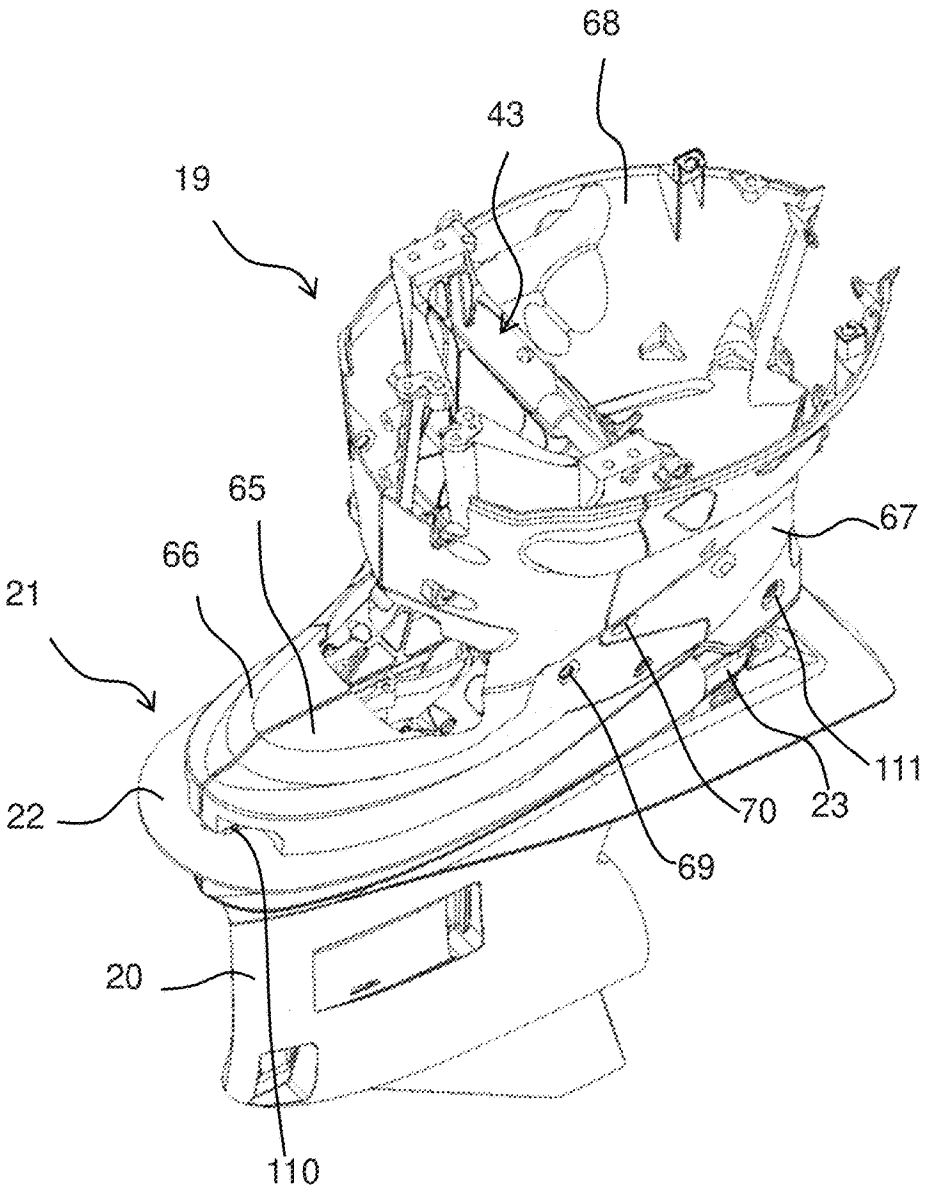
FIG. 9 is a perspective view of the lower portion of the outboard motor.

As illustrated in FIG. 9, the head portions of the bolts 61 to 64 are covered by the upper case 19. The upper case 19 is preferably made of metal such as aluminum or stainless steel, for example. Alternatively, the upper case 19 may be made of resin, for example. The upper case 19 includes a plurality of cover portions 65 to 68 that are separate from each other. Specifically, the upper case 19 includes a left front cover 65, a right front cover 66, a left rear cover 67, and a right rear cover 68. The left front cover 65, the right front cover 66, the left rear cover 67, and the right rear cover 68 are separate from each other. The left front cover 65 and the right front cover 66 are located above the bolts 61 to 64. The left front cover 65 and the right front cover 66 cover the head portions of the bolts 61 to 64 from above.

As illustrated in FIG. 5, the attachment 23 includes a second cover mount 57. The second cover mount 57 is located at the rear portion of the attachment 23. The second cover mount 57 includes a bolt hole 108.

As illustrated in FIG. 8, the frame 43 includes a plurality of bolt holes 58 and 59. The plurality of bolt holes 58 and 59 are provided on the lateral side surface of the frame 43. The left front cover 65 and the left rear cover 67 include holes 69 and 70 located at positions corresponding to the bolt holes 58 and 59, respectively. The left front cover 65 and the left rear cover 67 are fixed to the frame 43 by bolts extending through the holes 69 and 70 of the left front cover 65 and the left rear cover 67 and the bolt holes 58 and 59, respectively.

The left front cover 65 includes a hole 110 located at a position corresponding to the bolt hole 107 of the first case support 37. The left front cover 65 is fixed to the splash guard 21 by a bolt extending through the hole 110 of the left front cover 65 and the bolt hole 107 of the first case support 37. The left rear cover 67 includes a hole 111 located at a position corresponding to the bolt hole 108 of the second cover mount 57. The left rear cover 67 is fixed to the splash guard 21 by a bolt extending through the hole 111 of the left rear cover 67 and the bolt hole 108 of the second cover mount 57.

Although not illustrated, the right front cover 66 and the right rear cover 68 are fixed to the splash guard 21 by bolts in the same manner as the left front cover 65 and the left rear cover 67. In the drawings, reference numerals 58 and 59 indicate only some of the plurality of bolt holes 58 and 59, and the reference numerals of the other bolt holes are omitted. In the drawings, reference numerals 69 and 70 indicate only some of the plurality of holes 69 and 70, and the reference numerals of the other holes are omitted.

As illustrated in FIG. 6, the lower surface of the attachment 23 is open. The lower surface of the attachment 23 includes a plurality of bolt holes 71 to 76. The bolt holes 71 to 76 are located along the edge of the lower surface of the attachment 23. The attachment 23 includes a partition wall 77. The partition wall 77 divides the space inside the attachment 23 in the front and back direction.

Figure 10:
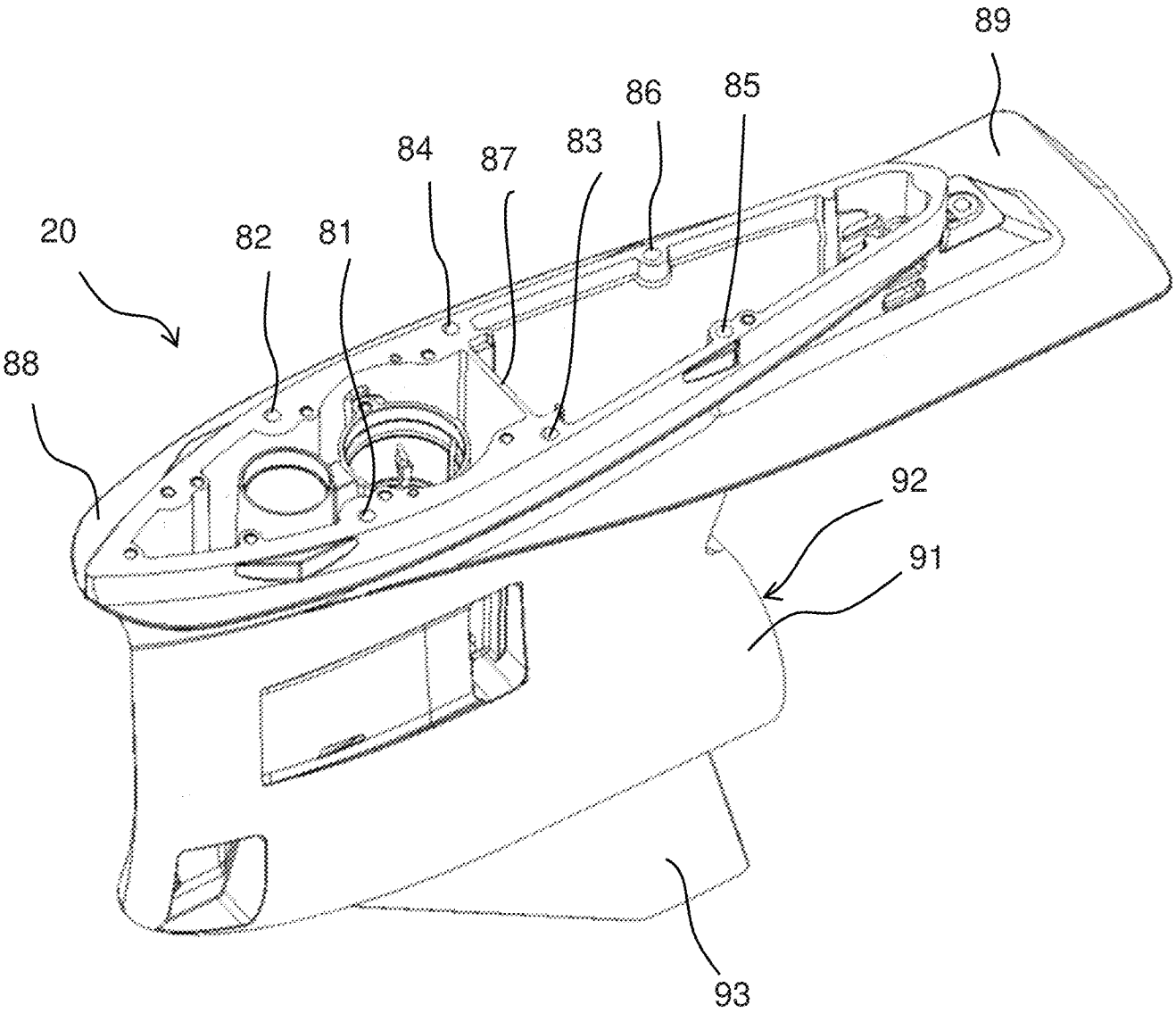
FIG. 10 is a perspective view of a lower case.
Figure 11:
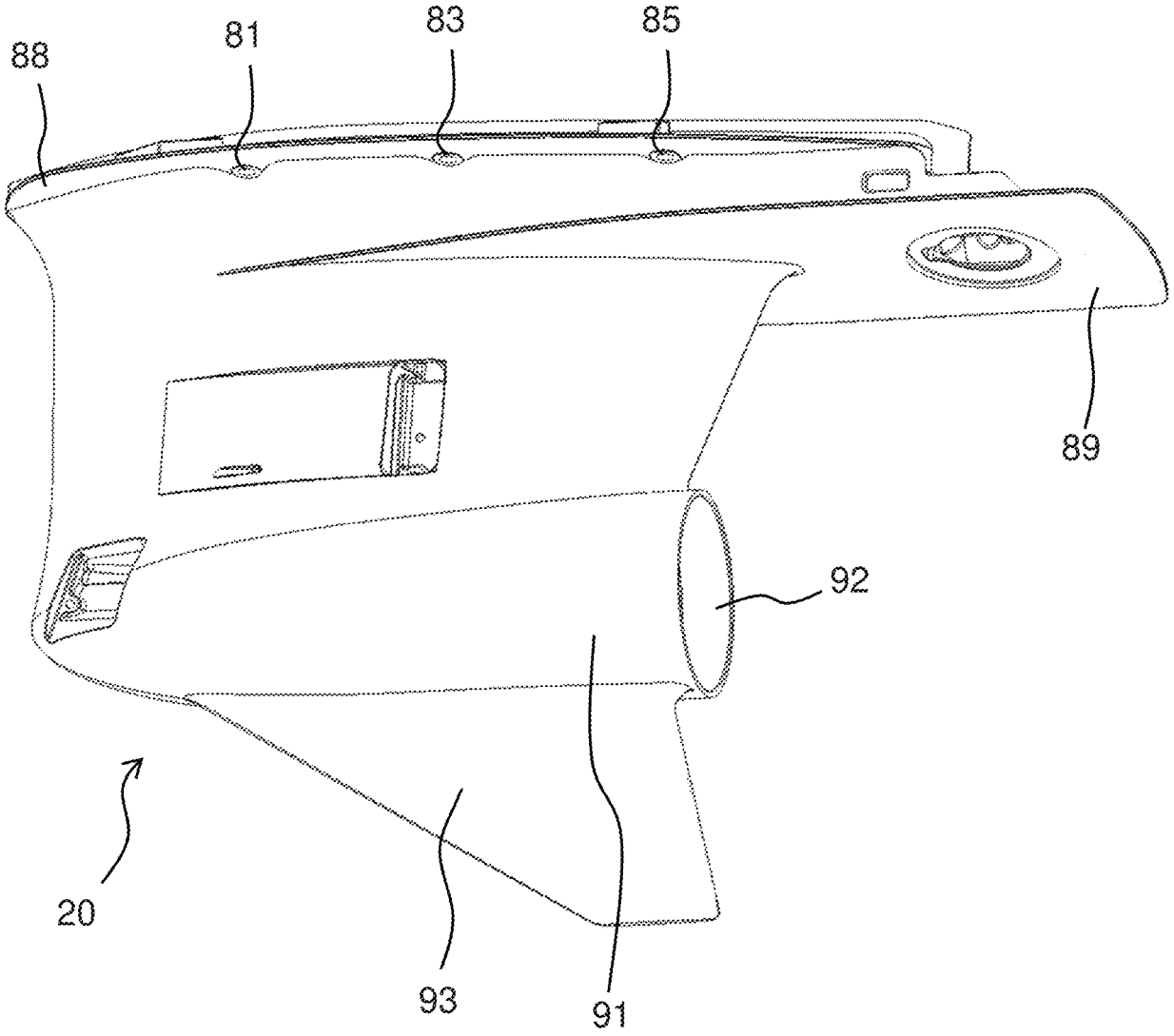
FIG. 11 is a perspective view of the lower case.

FIGS. 10 and 11 are perspective views of the lower case 20. The lower case 20 is preferably made of metal such as aluminum or stainless steel, for example. As illustrated in FIG. 9, the upper surface of the lower case 20 is open. The upper surface of the lower case 20 includes a plurality of holes 81 to 86. The plurality of holes 81 to 86 are located along the edge of the upper surface of the lower case 20. As illustrated in FIGS. 9 and 10, the plurality of holes 81 to 86 penetrate the lower case 20 in the vertical direction. Bolts (not illustrated) extend through the holes 81 to 86 of the lower case 20 and the bolt holes 71 to 76 of the attachment 23. As a result, the attachment 23 is fixed to the lower case 20. The lower case 20 includes a partition wall 87. The partition wall 87 divides the space inside the lower case 20 in the front and back direction.

A lower plate 88 and a cavitation plate 89 are connected to the lower case 20. The lower plate 88 and the cavitation plate 89 are preferably integral with the lower case 20. The lower plate 88 is located below the upper plate 22. The lower plate 88 is located below the upper surface of the lower case 20. The lower plate 88 projects from the lower case 20 to the left and right sides. The front end of the lower plate 88 is located rearward of the front end of the upper plate 22. The front end of the lower plate 88 is located forward of the front end of the cavitation plate 89. The lower plate 88, together with the upper plate 22, significantly reduces or prevents splashes rising from the stern of the boat.

The cavitation plate 89 is located below the upper plate 22. The cavitation plate 89 is located below the lower plate 88. The cavitation plate 89 projects rearward from the lower case 20. The cavitation plate 89 projects from the lower case 20 to the left and right sides. The cavitation plate 89 is located above the propeller 6.

The lower case 20 includes a propeller case 91 and a propeller hole 92. The propeller shaft 4 is provided in the propeller case 91. The propeller hole 92 is located on the rear surface of the propeller case 91. A propeller shaft 4 and a portion of the propeller 6 are provided in the propeller hole 92. The propeller hole 92 opens rearward. The lower case 20 includes a skeg 93. The skeg 93 extends downward from the propeller case 91.

In the outboard motor 1 according to a preferred embodiment of the present invention, the splash guard 21 is separate from the upper case 19 and is attached to the upper case 19. Therefore, the splash guard 21 is easier to manufacture than the case in which the splash guard 21 is integral with the upper case 19. Further, by removing the splash guard 21 from the upper case 19, the splash guard 21 is able to be easily replaced.

Although preferred embodiments of the present invention have been described above, the present invention is not limited to the above-described preferred embodiments, and various modifications can be made without departing from the gist of the present invention.

The structure of the outboard motor 1 is not limited to that of the above-described preferred embodiments, and may be changed. For example, the drive unit 2 is not limited to an internal combustion engine, and may be an electric motor. Alternatively, the drive unit 2 may be a hybrid system of an internal combustion engine and an electric motor.

The structure of the splash guard 21 is not limited to that of the above-described preferred embodiments, and may be changed. For example, the shape of the upper plate 22 may be changed. The upper plate 22 may be replaceable with one having a shape different from that described above. The shape of the attachment 23 may be changed. The attachment 23 may be replaceable with one having a shape different from that described above. The attachment 23 may be replaced according to the upper plate 22.

The lower plate 88 may be separate from the lower case 20. Alternatively, the lower plate 88 may be omitted. The structure of the upper case 19 or the lower case 20 is not limited to that of the above-described preferred embodiments, and may be changed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
a propeller shaft;
a lower case that accommodates the propeller shaft;
an upper case located above the lower case; and
a splash guard separate from the upper case; wherein
the splash guard is attached to the upper case and includes an upper plate that projects forward from the upper case;
the splash guard further includes an attachment separate from the lower case and the upper case;
the upper plate is attached to the upper case via the attachment;
the attachment is located between the lower case and the upper case; and
the attachment is attached to the lower case and the upper case.

2. The outboard motor according to claim 1, further comprising:
a lower plate located below the upper plate.

3. The outboard motor according to claim 2, wherein the lower plate is integral with the lower case.

4. An outboard motor comprising:
a propeller shaft;
a lower case that accommodates the propeller shaft;
an upper case located above the lower case; and
a splash guard separate from the upper case; wherein
the splash guard is attached to the upper case and includes an upper plate that projects forward from the upper case;
a lower plate is located below the upper plate; and a cavitation plate is located below the upper plate and projects rearward from the lower case.

5. An outboard motor comprising:

a propeller shaft;

a lower case that accommodates the propeller shaft;

an upper case located above the lower case; and a splash guard separate from the upper case; wherein the splash guard is attached to the upper case and includes an upper plate that projects forward from the upper case;

the splash guard further includes an attachment separate from the lower case and the upper case;

the upper plate is attached to the upper case via the attachment; and a bolt located is provided on an upper surface of the upper plate to fix the upper plate to the attachment.

6. The outboard motor according to claim 5, wherein the bolt is covered by the upper case.

* * * * *